United States Patent [19]

Wuthrich

[11] 4,376,996

[45] Mar. 15, 1983

[54] THIN STEPPING MOTOR WATCH

[75] Inventor: Paul Wuthrich, Watertown, Conn.

[73] Assignee: Timex Corporation, Waterbury, Conn.

[21] Appl. No.: 258,061

[22] Filed: Apr. 27, 1981

[51] Int. Cl.[3] ..... G04B 19/04

[52] U.S. Cl. ..... 368/220; 368/77; 368/221; 368/233

[58] Field of Search ..... 368/76, 200, 322, 77, 368/221, 233

[56] References Cited

U.S. PATENT DOCUMENTS

| | | | |
|---|---|---|---|
| Re. 22,640 | 4/1937 | Prins | 368/77 |
| 2,749,704 | 6/1956 | Heikkila | 368/233 |
| 2,794,314 | 6/1957 | Slaugh | 368/233 X |
| 3,538,703 | 11/1970 | Walton | 368/220 X |
| 3,668,858 | 6/1972 | Hartwig | 368/77 |
| 3,854,280 | 12/1974 | Wuthrich | 368/221 |
| 4,249,251 | 2/1981 | Wuthrich | 368/76 |

*Primary Examiner*—J. V. Truhe
*Assistant Examiner*—T. Flower
*Attorney, Agent, or Firm*—William C. Crutcher

[57] ABSTRACT

A quartz analog watch has a disc with a minute hand thereon driven directly at its periphery by the rotor of a stepping motor. A single intermediate gear and pinion assembly performs a gear reduction to drive a conventional hour hand rotatably mounted on a center spindle which also supports the minute disc. The stepping motor watch internal components, including battery, stepping motor, intermediate gear assembly and integrated circuit are all partially hidden beneath the minute disc. A special watch crystal functions also as a top frame member controlling "endshake" of the movement members in conjunction with the caseback. A special metal clip provides a push button contact for electrically setting the watch and also holds the intermediate gear assembly in place.

13 Claims, 8 Drawing Figures

THIN STEPPING MOTOR WATCH

BACKGROUND OF THE INVENTION

This invention relates generally to wristwatches driven by a stepping motor, and more particularly to a very thin wristwatch having a reduced number of components.

Stepping motor watches are known with conventional hour and minute hands driven by a stepping motor rotor, which periodically advances in response to electrical pulses. The pulses may be provided by an integrated circuit having a quartz oscillator time base. An exemplary patent of a stepping motor watch is shown in my U.S. Pat. No. 4,249,251 issued Feb. 3, 1981 and assigned to the present assignee.

Wristwatches of reduced thickness have been proposed, in which the hour hand and minute hand are painted or embossed on rotating discs which are driven at the periphery by a stepping motor, through an intermediate gear train, at least the upper disc being transparent. Such constructions are shown in published U.K. Patent Application No. GB 2050654A, assigned to Societe Suisse Pour L'Industrie Horologere Management Services, published Jan. 7, 1981, and No. GB 2056126A, assigned to Ebauches SA, published Mar. 11, 1981. While these patents provide wristwatches of reduced thickness, it is necessary to locate the components of the watch such as stepping motor, gear train, battery, quartz crystal and integrated circuit to either end of the watch outside of the periphery of the discs, thereby somewhat increasing its overall dimensions in return for its reduced thickness. Other patents showing timepieces which replace the hands by indicating discs are shown in Swiss Pat. No. 307,045 and in German Laid Open Application Nos. 2204907 and 2548559.

The use of discs driven at their periphery as a substitute for conventional time indicating hands offers certain possibilities to reduce the thickness of the timepiece. However, most constructions utilizing a disc have employed a transparent disc either with one or more conventional hands or another disc below it. A transparent disc removes any possibility of hiding watch components beneath it and hence they must be placed beyond the periphery of the disc, thereby increasing the overall size of the timepiece.

It is also necessary to control the axial movement or "endshake" or rotating parts, and to provide various electrically conductive elements. It would be desirable to have a very thin timepiece, which employs a minimum number of parts. The timepiece should be easy to assemble and the various components of the timepiece should perform multiple functions, both mechanical and electrical whenever possible, in order to reduce the cost and provide a more reliable timepiece.

Accordingly, one object of the present invention is to provide a thin wristwatch driven by a stepping motor.

Another object of the invention is to provide a thin wristwatch with a reduced number of components.

DRAWINGS

The invention, both as to organization and method of practice, together with further objects and advantages thereof will best be understood by reference to the following specification, taken in connection with the accompanying drawings, in which:

FIG. 1 is a plan view of the improved stepping motor wristwatch with portions of the crystal and minute disc removed to show the internal components, FIG. 2 is a cross-section elevation view of the watchcase and crystal assembly with the internal components removed, FIG. 2*a* is a fragmentary cross-sectional view similar to FIG. 2, but taken along lines 2*a*—2*a* at the corner of the watchcase illustrating connection between caseback and bezel, FIG. 3 is a developed elevation drawing, in cross-section illustrating the stepping motor and gear train, FIGS. 4 and 5 are fragmentary developed views in cross-section taken through portions of the battery and printed circuit board showing the means of interconnection with the battery clips, FIG. 6 is a plan view of the printed circuit board as viewed from the opposite or caseback side, and FIG. 7 is a fragmentary elevation view in cross-section taken through the time setting push button in the caseback and associated special clip.

SUMMARY OF THE INVENTION

Briefly stated, the invention is practiced by providing a thin stepping motor timepiece of the type having a crystal, a case, and a stepping motor driven by an electronic circuit, where the improvement comprises a minute disc with a minute indicating marker, the disc being rotatably mounted in the case and driven directly at its periphery by the stepping motor rotor pinion, an hour hand rotatably mounted above the disc, and an intermediate gear and pinion disposed below the disc driving the hour hand and being driven by a cannon pinion attached below the minute disc. In its preferred form, the rotatable components are supported on fixed posts in the caseback, and held in place by components which perform other functions as well. The intermediate gear and pinion is held in place by a special metal clip which also serves as the electrical connection for the time setting circuit operated by a push button in the caseback. The rotating minute disc and stepping motor rotor are held in place by the watch crystal.

DESCRIPTION OF THE PREFERRED EMBODIMENT

Figure 1:
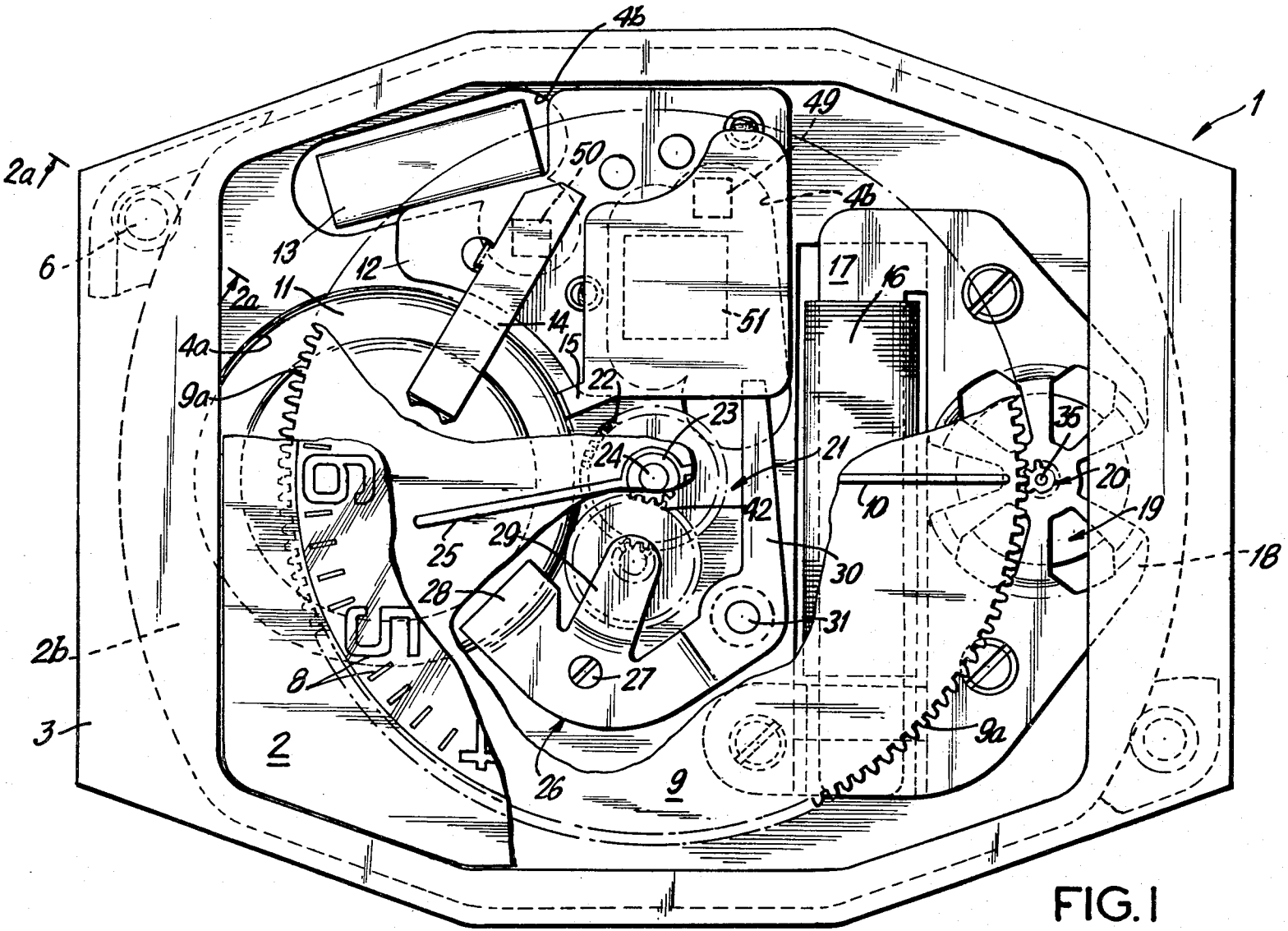
Figure 2:
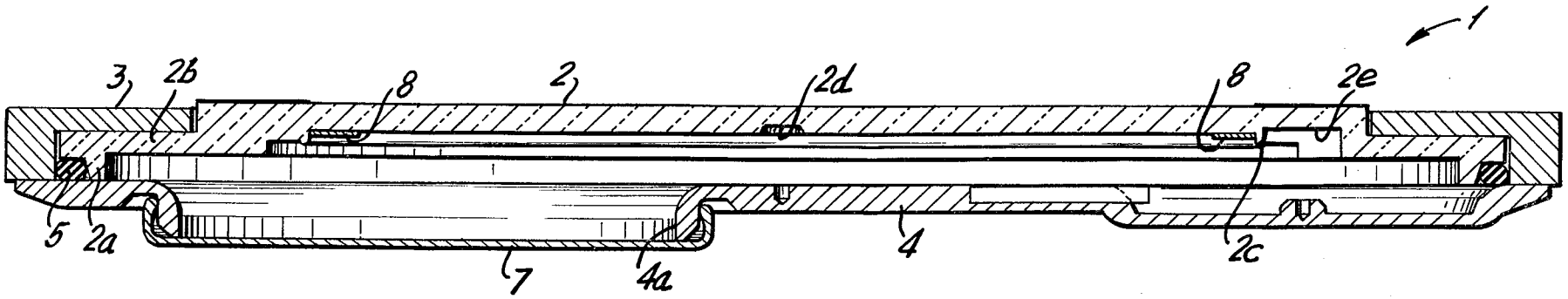
Figure 2A:
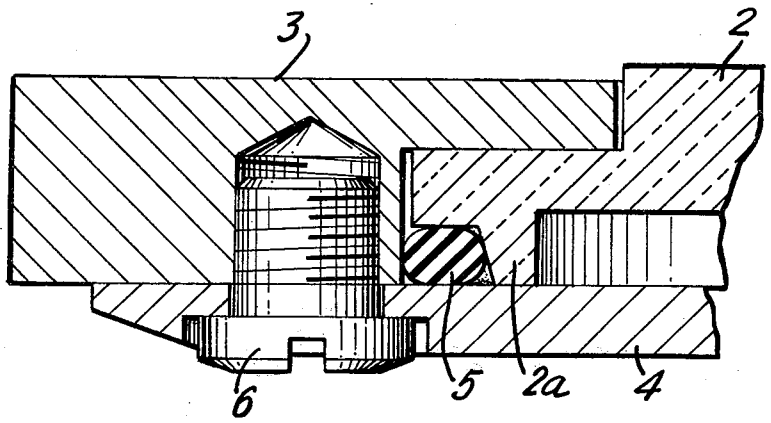

Referring now to FIG. 1 of the drawing, the wristwatch comprises a case shown generally at 1 and a crystal 2. Referring to the cross-section of FIG. 2 of the drawing, case 1 is seen to comprise a bezel 3, attached to a caseback 4. The crystal 2 is molded to provide a supporting pedestal 2*a* resting on portions of the caseback 4 and a peripheral lip 2*b* extending beneath the bezel. Grommet 5 provides a seal. Any suitable means may be employed for holding the caseback, bezel and crystal assembly together, but the preferred method is by the use of screws 6 at the bezel corners as indicated in FIG. 2*a*.

Caseback 4 includes a battery opening 4*a* covered by a battery cover 7. Crystal 2 is molded, for purposes to be later explained, so as to include a circular depending lip 2*c*, a center recess 2*d* and a recess 2*e*. Hour numerals and minute markers are printed or embossed in a circle on the underside of crystal 2 as indicated at 8. Alternatively, the numerals could be located radially outward of the location indicated on a metal ring carrying such markers, and adhesively attached to the crystal.

Referring back to FIG. 1 of the drawing, a portion of the crystal 2 with markers 8 is shown, but most of the crystal has been removed to show the internal components of the timepiece. Rotatably mounted within the timepiece case is a minute disc 9 having peripheral gear teeth 9*a*. Again, most of the disc 9 has been broken away to illustrate the movement and electrical components beneath it. Disc 9 has painted or embossed thereon a minute indicating pointer, such as a minute hand 10. Preferably the disc is opaque or substantially opaque so that the components beneath it are not visible. Similarly, part of crystal 2 is caused to be opaque or substantially opaque outside the periphery of disc 9 so as to hide the components beneath it. This may conveniently be done by painting a layer on either the outside or the underside of the crystal. Such a layer is illustrated on the outside in the views of FIGS. 2 and 3.

Beneath the minute disc 9 are a battery 11, a printed circuit board 12 carrying an integrated circuit and other discrete electronic components, such as a quartz crystal 13. Electrical connections are made between the battery 11 and terminals on the printed circuit board by a first metal clip 14 contacting to the center or negative terminal and a second metal clip 15 contacting to the rim or positive terminal of the battery (which is also grounded to the watchcase in conventional fashion through the battery cover 7).

The electric motor for the wristwatch can be one of many of the conventional types of stepping motors employed in wristwatches, with any number of coils or poles. However, the preferred stepping motor shown comprises a single coil 16 with leads attached to terminals on the printed circuit board 12, and core pieces 17 providing upper and lower spaced stator elements, one of which is shown at 18. The stator elements have a stepping motor rotor 19 cooperatively associated with them which incorporates a stepping motor pinion 20. In accordance with one aspect of the present invention, stepping motor rotor pinion 20 meshes directly with the teeth 9*a* of minute disc 9 so as to directly drive the same.

The remaining components, which will be later described in more detail, include an intermediate gear and pinion assembly 21, an hour wheel 22, connected to a center sleeve 23 rotatably mounted on a center post 24. An hour hand 25 is mounted on the sleeve 23 and is disposed above minute disc 9. Therefore, the hour hand 25 and the minute hand 10 are visible through the crystal, while the minute disc 9 also serves as the dial of the watch.

A special clip 26 is attached to the caseback by suitable means such as a screw at 27. Clip 26 includes a first extending portion 28 which rests against the battery serving to steady it, a second extending portion 29 which holds the intermediate gear and pinion assembly 21 in place in the caseback, and a third extending portion 30. Portion 30 is connected to the end of a push button 31 and also extends below, but not in contact with a terminal (not shown) on the underside of printed circuit board 12.

Figure 3:
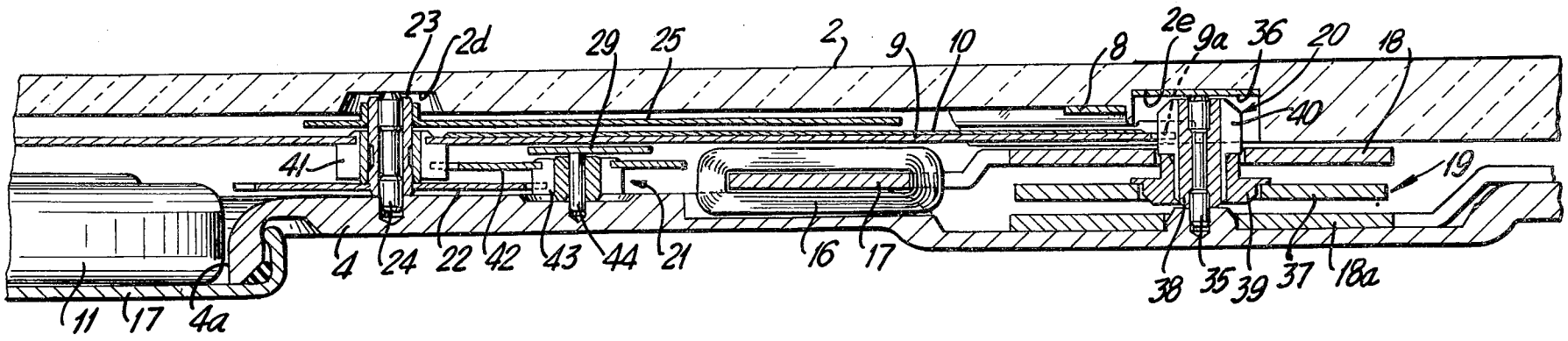

Referring now to FIG. 3 of the drawing, the enlarged cross-section shows that the upper stator member 18 of the stepping motor is disposed in spaced relationship with a corresponding lower stator member 18*a*. Stator 18*a* is also in magnetic circuit with the core 17 of coil 16, although this is not shown in the drawing. A fixed rotor post 35 extends from a hole in the caseback and abuts the underside of recess 2*e* in the crystal. A metal disc 36 in the recess hides the elements beneath it. Rotatably mounted on post 35 is the stepping motor rotor 19, which includes a permanently magnetized disc member 37 connected to a carrying sleeve 38 via hub 39. A toothed pinion 40 completes the stepping motor rotor assembly. Details of a suitable construction may be seen by reference to co-pending application Ser. No. 109,594 filed in the name of Migeon on Jan. 4, 1980 and assigned to the present assignee, now abandoned. In the present construction shown, the post 35 serves to support the very thin crystal 2, while the crystal also serves to hold the rotor in place and to control the axial movement or "endshake" of the rotor 19.

In a similar manner, a fixed center post 24 extends between caseback 4 and recess 2*d* in the crystal. Center post 24 serves to rotatably mount the movement components and to support the thin crystal at its center against damage. The crystal serves as a top frame member to hold the rotating components in place and to control the endshake of the rotating components.

Rotatably mounted on post 24 is a sleeve 23 having an hour wheel 22 connected on its lower end and having the hour hand 25 connected on its other end so as to be disposed above the minute disc 9. It should be noted that this is the reverse of the usual arrangement wherein a minute indicating hand is above or on the end of the shaft outside of the hour indicating hand.

Rotatably mounted on the outside of sleeve 23 is a cannon pinion sleeve 41, which rotatably supports dics 9 and has pinion teeth disposed beneath the disc. The aforementioned intermediate gear and pinion assembly 21 includes a large gear 42 meshing with and driven by cannon pinion teeth, and a pinion 43 meshing with and driving the hour wheel 22. The intermediate gear and pinion assembly 21 is rotatably mounted on a fixed post 44 extending from the caseback. The gear and pinion assembly is held in place and end shake is controlled by the special clip extension 29 bearing on the upper end of the post 44.

The overall gear reduction from the rotor pinion 40 to minute disc 9 is 30:1 with the preferred stepping motor, which steps 60° every 20 seconds, or two minutes per revolution. The gear ratio step down between cannon pinion 41 and the hour hand, provided through the intermediate gear and pinion assembly 21 is 12:1.

Figure 4:
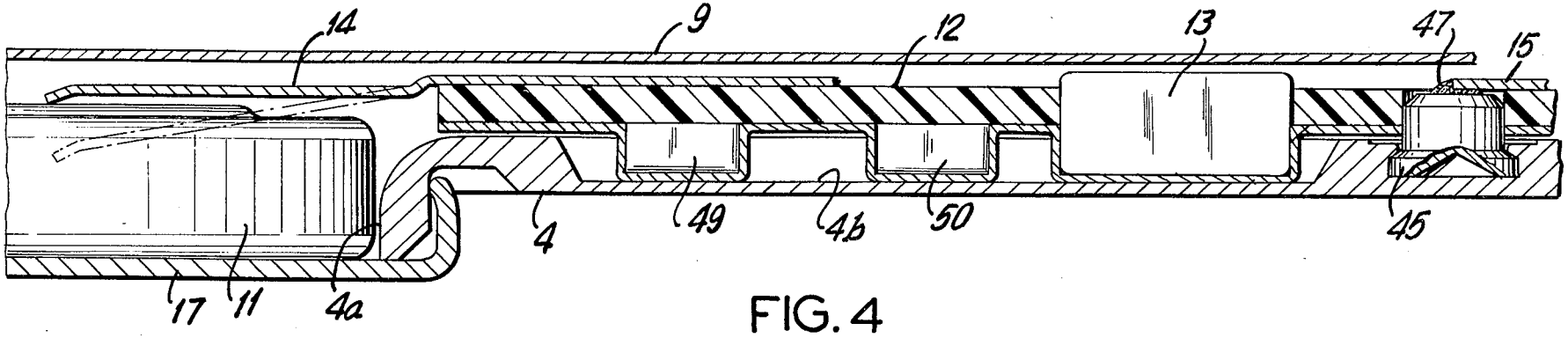
Figure 5:
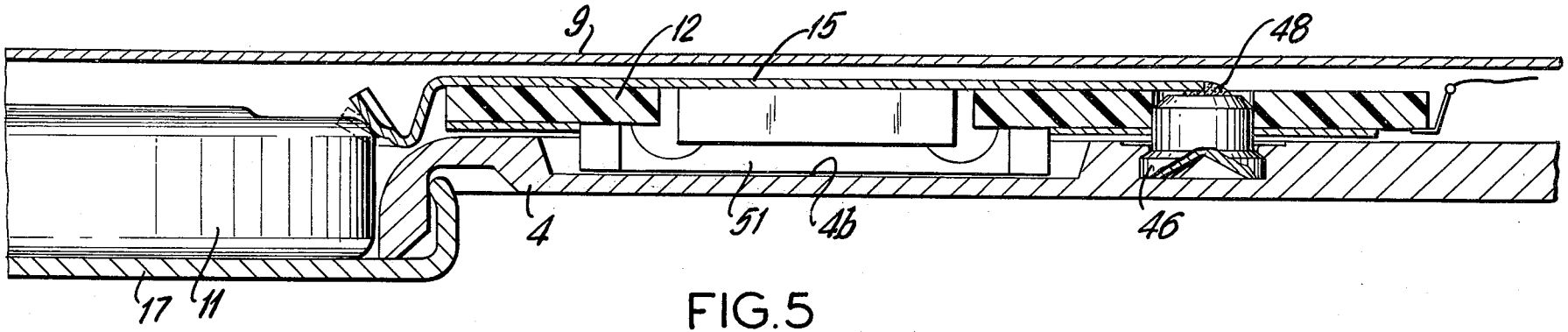

Referring to FIGS. 4 and 5 of the drawings, the printed circuit board arrangement will be described, the board being largely of conventional construction. The developed views are not true cross-sections but are intended to show the elevation details. The printed circuit boards are supported on fixed metal studs, such as 45, 46 which are staked in caseback 4. The board 12 is held in place by the metal clip 15 by soldering at 47, 48 to studs to 45, 46. This both holds the board and provides a grounding connection between battery and case.

Figure 6:
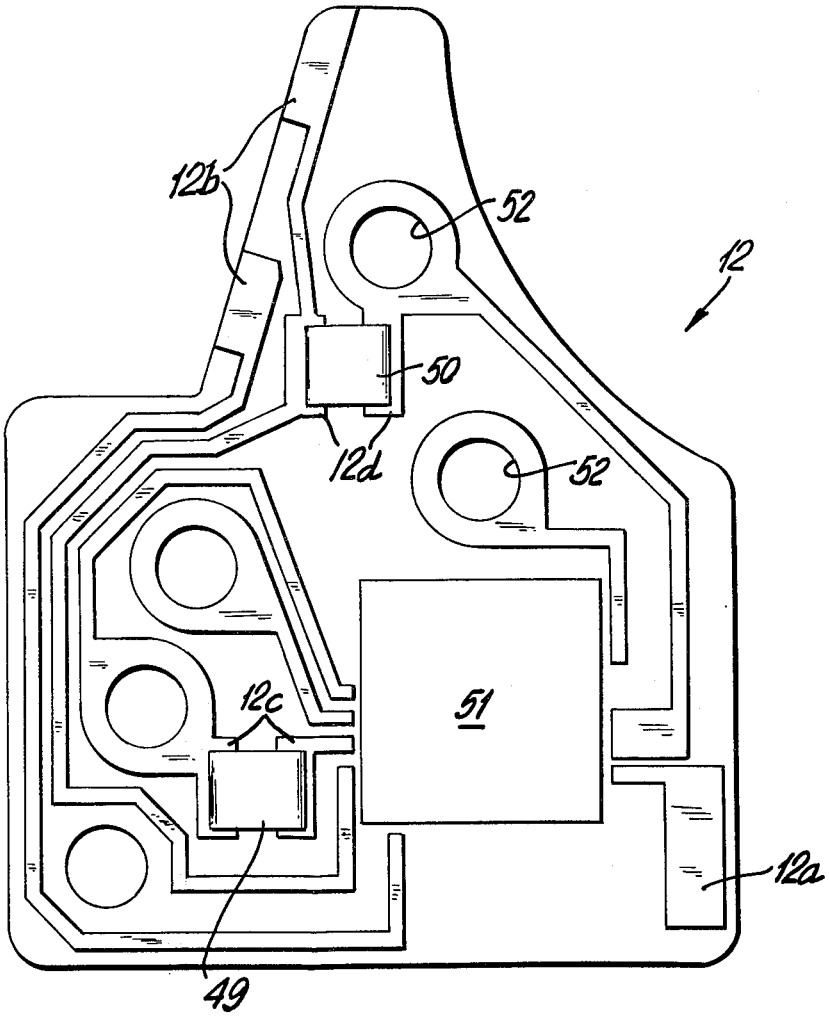

Reference to FIG. 6 shows the printed circuit board 12 looking from the caseback side or opposite to that shown in FIG. 1. Contact terminals are provided, such as a terminal 12*a* connected to the electric time setting circuitry, terminals 12*b* for attachment to the quartz crystal, and terminals 12*c*, 12*d* for connection to discrete components such as capacitors or resistors 49, 50. The encapsulated suitably enclosed integrated circuit is indicated at 51 and typical mounting holes are shown at 52.

Reference to the cross-sections of FIGS. 4 and 5 illustrates that the caseback 4 has cavities 4*b* milled therein to accommodate the protruding discrete electronic components such as 49, 50 (FIG. 4) and the integrated circuit (FIG. 5) which extends below the surface of the circuit board.

Figure 7:
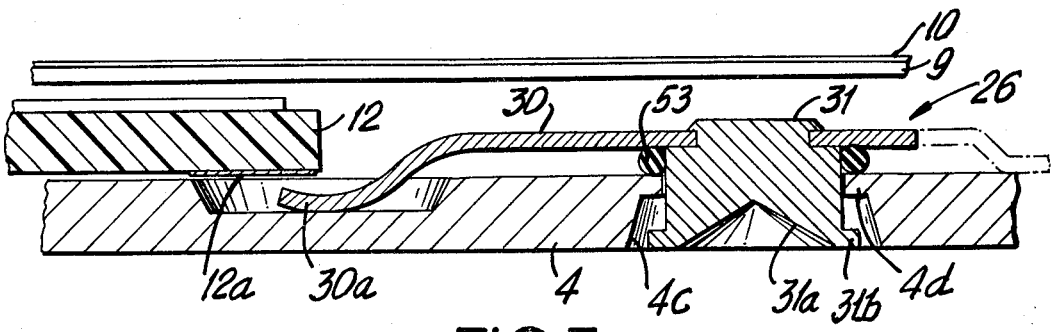

Referring now to FIG. 7 of the drawing, further details are shown concerning the special clip 26. A hole 4*c* in the caseback accommodates the push button 31. Push button 31 is flush with the surface of the caseback and is dimpled at 31*a* so that it can be actuated by a pointed object and not pushed inadvertently. An o-ring 53 seals the opening against entering moisture and a flange 31*b* on the push button cooperates with a lip 4*d* on the caseback to prevent pushing the button against the disc 10 above. The push button is attached to the extending portion 30 of the special clip 26 and held in the position shown by the spring action of the clip. The tip 30*a* of the extension 30 is arranged to make contact with the terminal 12*a* on printed circuit board 12 when the push button 31 is actuated. The push button may be used for any desired purpose, but in the preferred embodiment actuates the fast forward and reverse setting of the hands of the timepiece.

Thus, there has been described an improved thin stepping motor watch which employs an improved movement with a minimum of components. The use of a minute disc driven directly by the stepping motor rotor, and a single intermediate gear and pinion assembly to accomplish the drive reduction between minute disc and hour hand greatly simplifies construction and assembly of the watch. The combination of a minute hand on a disc which also serves as a dial to hide the movement components and an hour hand disposed above the disc enables a rugged watch which nevertheless has greatly reduced thickness. The further use of multiple purpose members such as crystal and electrical spring clips which both perform structural holding components for the rotating parts and serve their normal functions as well, simplifies the construction and minimizes the number of parts.

While there has been disclosed what is considered herein to be the preferred embodiment of the invention, other modifications will occur to those skilled in the art and it is desired to secure in the appended claims all such modifications as fall within the true spirit and scope of the invention.

I claim:

1. In a timepiece of the type having a crystal, a case with a caseback, a stepping motor having a rotor pinion disposed in said case, and an electronic circuit operating said stepping motor to turn said rotor pinion, the improvement comprising:

a minute disc rotatably mounted in the case and driven directly at its periphery by said rotor pinion, a fixed center post disposed in the caseback, a cannon pinion connected to said minute disc, rotatable means extending through said disc and said cannon pinion, comprising a sleeve rotatably mounted on said center post and having an hour wheel connected to its lower end, an hour hand mounted above said disc between the disk and the crystal on said rotatable means, and an intermediate gear and pinion assembly disposed below said disc and adapted to be driven by the cannon pinion and to drive said hour wheel.

2. The combination according to claim 1, wherein said center post abuts said watch crystal, whereby the axial movement of said sleeve is controlled between the watch crystal and the case.

3. The combination according to claim 1, and further including a fixed rotor post extending between caseback and crystal to thereby support portions of the crystal, and wherein said stepping motor rotor pinion comprises a sleeve rotatably supported on said rotor post, whereby the axial movement of the sleeve is controlled by the space between crystal and case.

4. The combination according to claim 1, wherein said crystal further includes a circular lip extending toward said minute disc near its periphery and closely spaced therefrom to limit tilting of the disc on its axis.

5. The combination according to claim 1, wherein said minute disc includes a minute hand indicator thereon arranged to resemble as closely as possible the rotatable hour hand disposed above it.

6. The combination according to claim 1, wherein said crystal includes a ring of timekeeping indices disposed on the crystal near the periphery of said minute disc, so as to mark the passage of time as the minute disc rotates.

7. The combination according to claim 1, wherein said electronic circuit, intermediate gear assembly and stepping motor are substantially disposed beneath said disc, and wherein said disc is substantially opaque.

8. The combination according to claim 1, wherein said case comprises a caseback attached to a bezel and sealingly holding the periphery of the crystal therebetween, said caseback supporting a plurality of fixed posts, said fixed posts respectively rotatably mounting said intermediate gear and pinion assembly, said rotatable means and said rotor pinion.

9. The combination according to claim 8, wherein the post rotatably mounting the rotor pinion abuts means on the crystal, whereby the crystal means holds the rotor pinion in place and controls axial movement.

10. The combination according to claim 8, wherein the post rotatably mounting the rotatable means abuts the crystal, whereby the crystal holds the rotatable means in place and controls axial movement.

11. The combination according to claim 8, further including a spring clip providing for an electrical connection to said electronic circuit, including a portion cooperating with the post rotatably supporting said intermediate gear and pinion assembly to hold it in place and control axial movement.

12. The combination according to claim 11, further including a push button adapted to actuate said spring clip to provide selective actuation of said electrical connection.

13. A thin stepping motor wristwatch comprising:

a molded crystal having a peripheral portion on its outside, and defining depending lip portions on its internal surface, a bezel overlapping said crystal peripheral portion, a caseback attached to the bezel to hold the crystal in place, a stepping motor disposed in said case, said stepping motor having a rotor pinion rotatably supported from a fixed rotor post in the caseback, a center post disposed in the caseback and abutting said crystal, a rotatable sleeve disposed on the center post having an hour hand connected to one end and an hour wheel connected to the other end, a cannon pinion rotatably disposed on said sleeve, a minute disc connected to the cannon pinion and having a minute hand painted or embossed thereon, said minute disc having teeth at its periphery engaging said rotor pinion and directly driven thereby, a intermediate gear and pinion assembly rotatably mounted on the caseback having a gear engaging and driven by said cannon pinion and an intermediate pinion engaging and driving said hour wheel, a battery connected to the circuit, said battery, electronic circuit, intermediate gear and pinion assembly and stepping motor being substantially disposed beneath and hidden by the minute disc.

* * * * *